United States Patent [19]

Ennis

[11] Patent Number: 4,765,418

[45] Date of Patent: Aug. 23, 1988

[54] BOREHOLE DRILL CONSTRUCTION

[76] Inventor: Melvyn S. J. Ennis, 19 Wynnland Park, Carnmoney, Newtonabbey, County Antrim, Northern Ireland, BT6 6SE

[21] Appl. No.: 41,600

[22] Filed: Apr. 22, 1987

[30] Foreign Application Priority Data

May 7, 1986 [GB] United Kingdom ..... 8611091

[51] Int. Cl.[4] ..... E21B 4/14; E21B 17/046; E21B 17/07

[52] U.S. Cl. ..... 175/396; 175/321; 175/393

[58] Field of Search ..... 175/320, 321, 322, 415, 175/414, 417, 418

[56] References Cited

U.S. PATENT DOCUMENTS

| | | | |
|---|---|---|---|
| 2,252,912 | 8/1941 | Armentrout | 175/417 X |
| 3,163,244 | 12/1964 | Zimmerman | 175/418 |
| 3,299,971 | 1/1967 | Lewis | 175/321 X |

*Primary Examiner*—Stephen J. Novosad

*Attorney, Agent, or Firm*—Balogh, Osann, Kramer, Dvorak, Genova & Traub

[57] ABSTRACT

A borehole drill construction comprising a cylindrical casing, a chuck mounted on one end of the casing by means of a screw-thread and a cutter head carried by the chuck. The chuck has at least one axially projecting dog thereon which is received in a corresponding recess in the cutter head to provide a means to transmit torque from the casing to the cutter head via the chuck. The cutter head is retained on the bit by at least one plug projecting into a slot in the cutter head, which is permitted limited axial movement thereby.

6 Claims, 2 Drawing Sheets

BOREHOLE DRILL CONSTRUCTION

This invention relates to a borehole drill construction, particularly, but not exclusively, a hammer-type drill construction.

It is already known to utilize a drill string consisting of coaxial tubes on the lower end of which a cutter head is mounted, the cutter head being rotated by turning of the entire drill string and a hammer action being obtained by means of a hammer mechanism driven by pressurized fluid conveyed to the hammer mechanism through the annular-section space between tubes.

With such an arrangement it has previously been proposed (see for example, GB No. 2117428B) to mount the cutter head in a chuck in which driving torque is transmitted from the outer tube of the drill string to the cutter head via splines in a shank portion of the cutter head and co-acting plugs or "half moon" rings mounted in the chuck. With this arrangement it has been found that the wear on the splines can be very rapid, resulting in the need for relatively frequent drill string withdrawals to permit chuck/cutter head changes. Furthermore, damage to the chuck/cutter head combination may result in the cutter head becoming detached, in which case the borehole may have to be abandoned.

An object of the invention is to provide a hammer-type drill with an improved chuck/cutter head arrangement.

In accordance with the invention there is provided a borehole drill construction having a tubular casing adapted at one end for connection to a drill string, said casing tube being internally screw-threaded at the other end; a tubular chuck member having at one end a screw-threaded portion engaged with the internal screw-thread of said casing, and at the other end at least one axially projecting dog portion; a cutter head having a recess for receiving said dog portion and a stem portion extending through the screw-threaded portion of the chuck member; retaining means for preventing removal of the cutter head from the chuck member while the latter is in position on the casing; the cutter head being permitted limited axial movement relative to the chuck member and said dog portion providing a driving connection between the casing and the cutter head.

With such an arrangement, the use of an axially extending dog portion on the chuck member to provide the driving connection simplifies assembly of the chuck and cutter head and also ensures that the drive torque can be transmitted through heavily constructed parts and at a greater radial distance from the drill axis than has been possible in conventional constructions.

An example of the invention is shown in the accompanying drawing, wherein

Figure 1:
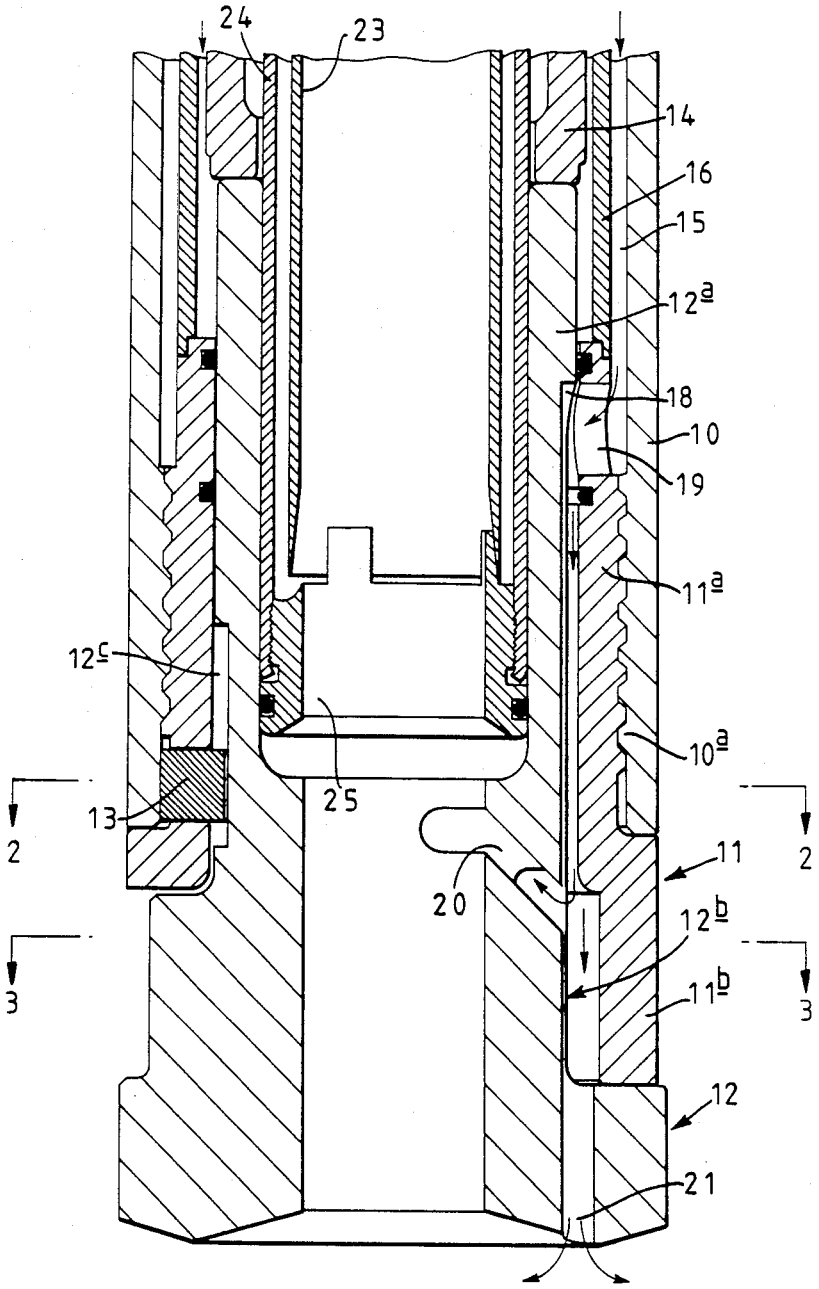
FIG. 1 is a fragmentary sectional view of a hammer-type drill.
Figure 2:
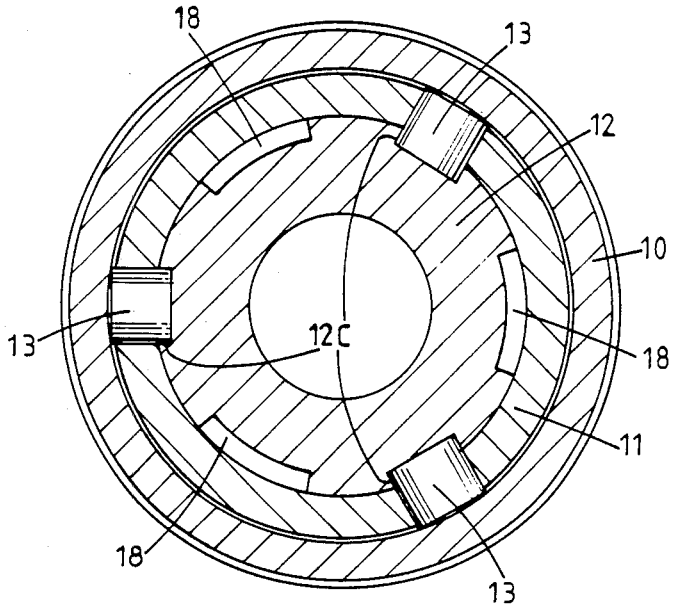
FIG. 2 is a sectional view of the hammer-type drill taken along Lines 2—2 in FIG. 1.
Figure 3:
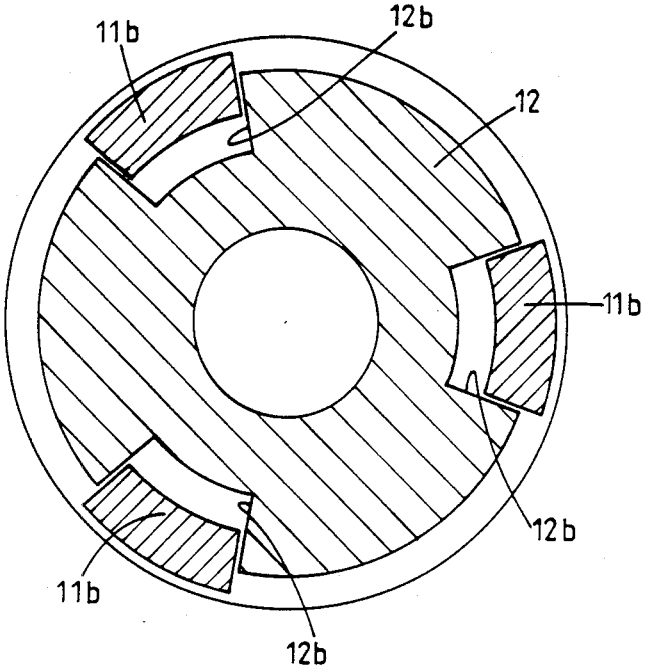
FIG. 3 is a sectional view of the hammer-type drill taken along Lines 3—3 in FIG. 1.

The hammer-type drill shown has an outer tubular casing 10 which, for use, is connected at its upper end to the outer tube of a coaxial drill string (not shown). The lower end of the casing 10 has an internal screw-thread 10*a*.

A tubular chuck member 11 has a portion 11*a* which is external screw-threaded to fit the internal screw-thread 10*a*. The chuck member 11 has at least one axially projecting dog portion 11*b*, the outer surface of which is substantially flush with the outer surface of the casing 10. Preferably there are two or more such dog portions.

A cutter head 12, in which there are set a plurality of cutter teeth (not shown) is retained on the casing 10 by means of the chuck member 11. This cutter head has a stem portion 12*a* which is a sliding fit inside the tubular chuck member 11. Furthermore, the cutter head is formed with a recess or recesses 12*b* in which the dog portion lies or the dog portions lie.

At least one recess or, as shown several, e.g. three recesses 12*c* in the stem portion 12*a* of the cutter head 12 receive plugs 13 fitted in cross-bores in the wall of the chuck member 11. These recesses 12*c* are so dimensioned in relation to the plugs that the plugs act to limit downward axial movement of the cutter head 12 relative to the chuck member 11, but upward relative movement is limited by direct contact between the cutter head 12 and the free end of the dog portion 11*b*.

It is a very simple matter to assemble the cutter head 12 and the chuck member 11 on the casing 10. The chuck member 11 is partially inserted into the casing and turned to engage the screw-threads to a point such that the cross-bores in the wall of the chuck member are still clear of the end of the casing 10. The cutter head can then be inserted in the correct alignment to cause the dog portion(s) 11*b* of the chuck member to enter the recess(es) in the cutter head. The plugs 13 are inserted and the chuck member is then turned further to complete insertion and tightening up thereof.

The plugs 13 are retained by the casing 10 and in turn retain the cutter head which is, however left free for limited axial movement. Torque for driving the cutter head is applied via the dog portion(s) 11*b* and not via the plugs 13. The upper end of the stem portion 12*a* of the cutter head projects above the upper end of the chuck and lies in the path of a hammer 14 of a fluid driven hammer mechanism (not shown) of known construction.

In the example shown, the exhaust passage of the pneumatic hammer mechanism is a passage 15 of annular section between the casing 10 and a lining tube 16, which abuts the upper end of the chuck. Exhaust air actually passes out of the drill through a longitudinal groove 18 in the exterior of the stem portion 12*a* of the cutter head 12. The groove communicates with the passage 15 via a port 19 in the wall of the chuck adjacent the upper end thereof.

The groove 18 extends along the stem portion of the cutter head and communicates with an angled internal exhaust port 20 in the cutter head which directs some of the exhaust air upwardly into the interior of the cutter head 12, and with an axial exhaust port 21 in the cutter head, which directs the remaining exhaust air out onto the leading face of the cutter head to provide a cooling airflow thereto. It will be noted that the groove 18 actually leads air to the recess 12*b* so that the exhaust airflow has the effect of "washing" the interengaging surfaces of the chuck and the cutter head so as to remove chips and particles and reduce wear on these surfaces.

The internal port 20 may be omitted so as to maximize this "washing" effect.

When the drill string is lifted or the drill enters an underground cavity, the cutter head can drop relative to the chuck and this has the effect of blocking the exhaust port 19, which stops operation of the hammer mechanism. This dropping effect is speeded up by the action of the exhaust air pressure on the cutter head.

The drill construction shown also includes a sampling tube 23 which is used to carry chippings created during drilling back to the ground surface installation. This tube 23, and an inner lining tube 24 surrounding it form an annular passageway through which high pressure flushing air can reach an upturned annular nozzle formed by an end piece 25. This nozzle directs the flushing air upwardly into the sampling tube and causes chippings etc. to be entrained. The sampling tube and nozzle arrangement is not essential to the present invention.

The actual cutting face of the cutter head can take a variety of different forms and an appropriate cutter head is chosen according to the nature of the strata through which the borehole passes and whether it is required to take a disturbed core sample or an undisturbed sample or whether normal external flushing is to be employed.

The stem portion of the cutter head is a relatively close tolerance fit in the axial bore in the chuck over a relative long axial range to ensure that the cutter head is accurately centered and rigidly held. This improves the life expectancy of the cutter head and the chuck.

It has been found that the use of the dog portions **11*b* to transmit torque instead of plugs like plug 13** or half moon rings, significantly extends the useful life of the cutter head and chuck.

It will, of course, be appreciated that the chuck member and cutter head could be used on a single tube drill string without any built in hammer mechanism, or on a hammer drill using external flushing.

We claim:

1. A borehole drill construction having a tubular casing adapted at one end for connection to a drill string, said casing tube being internally screw-threaded at the other end; a tubular chuck member having at one end a screw-threaded portion engaged with the internal screw-thread of said casing, and at the other end at least one axially projecting dog portion; a cutter head having a recess for receiving said dog portion and a stem portion extending through the screw-threaded portion of the chuck member; retaining means for preventing removal of the cutter head from the chuck member while the latter is in position on the casing; the cutter head having a limited axial movement relative to the chuck member, and said dog portion providing a driving connection between the casing and the cutter head.

2. A borehole drill construction as claimed in claim 1 in which there is a plurality of said dog portions on the chuck member and the cutter head has a plurality of recesses for receiving respective ones of the dog portions.

3. A borehole drill construction as claimed in claim 1 in which said retaining means comprises at least one plug housed in a cross bore in the wall of the chuck within said casing, said plug projecting inwardly into a recess in the stem portion of the cutter head, said plug limiting downward axial movement of the cutter head in use, but upward axial movement being limited by direct contact between the cutter head and the free end of the dog portion.

4. A borehole drill construction as claimed in claim 1 which also includes a hammer driven by compressed air, exhaust air from the hammer passing through a port in the chuck which is closed by the stem portion of the piston if the cutter head is allowed to drop relative to the chuck.

5. A borehole drill construction as claimed in claim 4 in which the outer surface of the stem portion of the cutter head is formed with an axially extending groove communicating with said port and with said recess in the cutter head, whereby exhaust air "washes" the interengaged faces of the chuck and cutter head.

6. A borehole drill construction having a tubular casing adapted at one end for connection to a drill string, said casing tube being internally screw-threaded at the other end; a tubular chuck member having at one end a screw-threaded portion engaged with the internal screw-thread of said casing, and at the other end at least one axially projecting dog portion; a cutter head having a recess for receiving said dog portion and a stem portion extending through the screw-threaded portion of the chuck member; retaining means for preventing removal of the cutter head from the chuck member while the latter is in position on the casing; the cutter head having a limited axial movement relative to the chuck member, and said dog portion providing a driving connection between the casing and the cutter head, in which said retaining means comprises at least one plug housed in a cross bore in the wall of the chuck within said casing, said plug projecting inwardly into a recess in the stem portion of the cutter head, said plug limiting downward axial movement of the cutter head in use, but upward axial movement being limited by direct contact between the cutter head and the free end of the dog portion.

* * * * *